US010718081B2

(12) United States Patent
Choi et al.

(10) Patent No.: US 10,718,081 B2
(45) Date of Patent: Jul. 21, 2020

(54) DRAIN PUMP FOR LAUNDRY TREATING APPARATUS

(71) Applicant: LG Electronics Inc., Seoul (KR)

(72) Inventors: Hoon Choi, Seoul (KR); Donggi Shin, Seoul (KR); Gunho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 151 days.

(21) Appl. No.: 15/620,980

(22) Filed: Jun. 13, 2017

(65) Prior Publication Data

US 2017/0356120 A1 Dec. 14, 2017

(30) Foreign Application Priority Data

Jun. 13, 2016 (KR) ..... 10-2016-0073371

(51) Int. Cl.
*D06F 39/08* (2006.01)
*D06F 39/12* (2006.01)
(Continued)

(52) U.S. Cl.
CPC ..... *D06F 39/085* (2013.01); *D06F 39/088* (2013.01); *D06F 39/125* (2013.01);
(Continued)

(58) Field of Classification Search
CPC .... D06F 39/085; D06F 39/088; D06F 39/125; D06F 39/083; D06F 29/00; D06F 37/20;
(Continued)

(56) References Cited

U.S. PATENT DOCUMENTS 2,884,776 A * 5/1959 Hughes ..... D06F 39/085 415/108
3,136,254 A * 6/1964 Douglas ..... D06F 39/085 415/206
(Continued)

FOREIGN PATENT DOCUMENTS

CN 102373608 3/2012
CN 102465886 5/2012
(Continued)

OTHER PUBLICATIONS

Extended European Search Report in European Application No. 17175431.0, dated Sep. 5, 2017, 6 pages (with English translation).
(Continued)

*Primary Examiner* — Hung Q Nguyen
*Assistant Examiner* — Brian P Monahon
(74) *Attorney, Agent, or Firm* — Fish & Richardson P.C.

(57) ABSTRACT

A drain pump for a laundry treating apparatus includes a housing, an impeller, a motor, a circulation outlet, and a drain outlet. The circulation outlet and the drain outlet are defined on an outer circumferential surface of the housing, enable communication of the washing water with the housing, and protrude outward in directions tangential to the outer circumferential surface. The housing includes a rib that protrudes from an inner circumferential surface of the housing, that is located between the circulation outlet and the drain outlet, and that is configured to guide the washing water to the circulation outlet or to the drain outlet based on a direction of rotation of the impeller.

20 Claims, 8 Drawing Sheets

(51) Int. Cl.

| | |
|---|---|
| ***F04D 29/42*** | (2006.01) |
| ***F04D 29/50*** | (2006.01) |
| ***F04D 15/00*** | (2006.01) |
| ***D06F 29/00*** | (2006.01) |
| ***D06F 37/20*** | (2006.01) |
| ***A47L 15/42*** | (2006.01) |

(52) U.S. Cl.
CPC ..... *F04D 15/0016* (2013.01); *F04D 29/4293* (2013.01); *F04D 29/506* (2013.01); *A47L 15/4221* (2013.01); *A47L 15/4225* (2013.01); *D06F 29/00* (2013.01); *D06F 37/20* (2013.01); *D06F 39/083* (2013.01)

(58) Field of Classification Search
CPC ..... F04D 29/506; F04D 29/4293; F04D 15/0016; A47L 15/4225; A47L 15/4223
See application file for complete search history.

(56) References Cited

U.S. PATENT DOCUMENTS

| | | | | | |
|---|---|---|---|---|---|
| 3,183,837 | A * | 5/1965 | Helliwell | F04D 29/466 | 415/148 |
| 3,257,950 | A * | 6/1966 | Toma | D06F 39/085 | 415/224 |
| 3,510,229 | A * | 5/1970 | Smith | A47L 15/4225 | 415/141 |
| 3,836,001 | A * | 9/1974 | Heldreth | B01D 35/26 | 210/167.01 |
| 3,851,993 | A * | 12/1974 | Foster | A47L 15/4225 | 415/52.1 |
| 4,091,644 | A * | 5/1978 | Bochan | D06F 39/085 | 415/146 |
| 4,331,295 | A * | 5/1982 | Warihashi | B05B 1/10 | 239/284.1 |
| 4,869,076 | A * | 9/1989 | Sakai | F25C 1/12 | 62/347 |
| 4,923,366 | A * | 5/1990 | Kern | D06F 39/085 | 415/107 |
| 5,377,707 | A * | 1/1995 | Young, Jr. | A47L 15/4204 | 134/104.1 |
| 5,934,872 | A * | 8/1999 | Yamauchi | F04D 15/0016 | 415/146 |
| 2002/0048513 | A1 | 4/2002 | Kleemann et al. | | |
| 2004/0191062 | A1* | 9/2004 | Dahlheimer | A47L 15/4225 | 415/231 |
| 2010/0012159 | A1* | 1/2010 | Verma | A47L 15/4225 | 134/104.2 |
| 2012/0114473 | A1* | 5/2012 | Badafem | F04D 29/426 | 415/203 |
| 2014/0286747 | A1* | 9/2014 | Fang | F04D 29/4293 | 415/1 |
| 2016/0115635 | A1 | 4/2016 | Lee et al. | | |
| 2017/0276138 | A1* | 9/2017 | Han | F04D 29/486 | |
| 2019/0368495 | A1* | 12/2019 | Matsui | H02K 9/19 | |

FOREIGN PATENT DOCUMENTS

| | | |
|---|---|---|
| DE | 102014222050 | 3/2016 |
| JP | 199843119 | 2/1998 |
| JP | 2014185638 | 10/2014 |
| JP | 2016056761 | 4/2016 |
| KR | 1020130109354 | 10/2013 |
| WO | WO2009157350 | 12/2009 |

OTHER PUBLICATIONS

Chinese Office Action in Chinese Appln. No. 201710441440.4, dated Jan. 25, 2019, 14 pages (with English translation).

* cited by examiner

DRAIN PUMP FOR LAUNDRY TREATING APPARATUS

CROSS-REFERENCE TO RELATED APPLICATION

Pursuant to 35 U.S.C. § 119(a), this application claims the benefit of an earlier filing date of and the right of priority to Korean Application No. 10-2016-0073371, filed on Jun. 13, 2016, the contents of which are incorporated by reference herein in its entirety.

BACKGROUND OF THE INVENTION

1. Field of the Invention

This specification relates to a drain pump for a laundry treating apparatus capable of draining or circulating washing water introduced from a drum.

2. Background of the Invention

A laundry treating apparatus serves to remove contaminations on laundry by introducing clothes, bedclothes, etc. (hereinafter, will be referred to as laundry) into a drum, and performs a washing process, a rinsing process, a dehydrating process, a drying process, etc.

The laundry treating apparatus is classified into a top loading type and a front loading type according to a method to introduce laundry into a drum. Generally, such a front loading type of washing machine is called a drum washing machine.

FIG. 1 shows an appearance of a drum washing machine, and FIG. 2 shows an inner shape of the drum washing machine of FIG. 1.

The laundry treating apparatus includes a cabinet 11 which forms an appearance thereof, a drum 21 rotatably mounted in the cabinet 11 and into which laundry is introduced, a lifter (not shown) installed in the drum 21, and a door 12 installed on a front surface of the cabinet 11. A detergent introducing opening cover 13 for covering a detergent introducing opening is disposed at a lower part of the cabinet 11. The laundry treating apparatus further includes a duct 15 and a heat exchanger 20, because air should circulate in order to dry laundry accommodated in the drum 21.

The front loading type of washing machine, i.e., the drum washing machine 10, performs a washing process by rotating the drum 21 when laundry is accommodated in the drum and water is supplied to the drum, and performs a rinsing process, a dehydrating process, etc. to discharge washing water to the outside by a drain pump. The drum washing machine 10 is provided with a circulation pump for circulating water inside the drum 21 during a washing process, and a drain pump for discharging washing water generated during the washing process to the outside.

In the conventional drum washing machine, the circulation pump for circulating washing water and the drain pump for discharging washing water are driven by separate motors. In this case, an installation space is restricted, and high costs are required because a plurality of motors are installed.

In order to solve such problems, one motor and one impeller are used, and a circulation pump and a drain pump are implemented by converting a rotation direction of the impeller. However, in case of performing a drain process and a circulation process by converting a direction of a flow path of washing water, the washing water may backflow toward an undesired flow path during the circulation process or the drain process.

Accordingly, required is an apparatus which does not restrict an installation space inside a laundry treating apparatus by serving as a drain pump and a circulation pump by using a single motor and a single impeller, the apparatus capable of preventing washing water from backflowing to an undesired flow path during a drain process or a circulation process.

SUMMARY OF THE INVENTION

Therefore, an aspect of the detailed description is to provide a structure of a drain pump capable of serving as both a drain pump and a circulation pump.

Another aspect of the detailed description is to provide a structure to perform a drain process or a circulation process by moving washing water introduced into a drain pump, in a specific direction.

Another aspect of the detailed description is to provide a structure to make washing water move toward a drain opening by rotating the washing water in a drain pump in one direction, or a structure to make washing water move toward a circulation opening by rotating the washing water in a drain pump in another direction.

Another aspect of the detailed description is to provide a structure of a drain pump, capable of preventing washing water from backflowing to a drain opening during a circulation process, and capable of increasing a water amount by smoothly moving the washing water towards a circulation opening.

Another aspect of the detailed description is to provide a structure of a drain pump, capable of preventing washing water from backflowing to a circulation opening during a drain process, and capable of increasing a water amount by smoothly moving the washing water towards a drain opening.

To achieve these and other advantages and in accordance with the purpose of this specification, as embodied and broadly described herein, there is provided a drain pump for a laundry treating apparatus, comprising: a housing formed to have a cylindrical shape, and configured to accommodate therein washing water introduced through an inlet communicated with a drain pump chamber; a motor configured to transmit a driving force such that an impeller mounted to the housing is rotated; and a circulation opening and a drain opening protruding from an outer circumferential surface of the housing in a tangential direction, forming a moving path of the washing water by being communicated with the housing, and spaced apart from each other, wherein the housing is provided with a rib protruding from one end of an inner circumferential surface of the housing towards inside of the housing, the rib formed between the circulation opening and the drain opening, and wherein the rib guides the washing water to the circulation opening or the drain opening by rotation of the impeller in one direction. With such a configuration, a flow of washing water can be formed by rotation of the impeller, and a decrease of a water amount due to a backflow of the washing water when the washing water flows in one direction can be prevented.

A washing water flowing portion for flowing the accommodated washing water by rotation of the impeller is formed on an inner circumferential surface of the housing. And the washing water flowing portion includes: a first groove recessed towards a position communicated with the circulation opening and configured to guide a movement of liquid accommodated in the housing; and a second groove recessed towards a position communicated with the drain opening, and configured to guide a movement of liquid accommodated in the housing.

The first groove and the second groove are recessed in different shapes.

The first groove is formed to have a wider recessed area than the second groove.

The rib is formed to have its thickness decreased towards the second groove from the first groove.

The rib is formed to be spaced apart from the impeller by a predetermined distance, such that the impeller is rotatable.

The rib is provided with a curved portion on its outer circumferential surface, the curved portion formed to correspond to an appearance of the impeller.

Protrusions protruding outward from an outer circumferential surface of the housing are formed at constant intervals therebetween at the housing, so as to be fixed in a fitted manner to protrusion accommodating portions of an impeller case which supports the impeller.

The motor is formed as a BLDC motor having its driving speed and driving direction controllable.

The drain pump for a laundry treating apparatus further comprises a controller configured to send a signal to the motor such that the impeller has a preset rotation direction and speed.

The present invention may have the following advantages.

Firstly, since the drain pump of the present invention can serve as both a drain pump and a circulation pump, by using a single motor and a single impeller, an installation space inside the laundry treating apparatus is not restricted. Further, lower costs are required than in a case that a drain pump and a circulation pump are individually driven.

Further, a drain process or a circulation process can be performed by rotating washing water introduced into the drain pump, clockwise or counterclockwise, by converting a rotation direction of the impeller.

Further, washing water can move toward the drain opening by being rotated in the drain pump in one direction, or washing water can move toward the circulation opening by being rotated in another direction. And a moving speed of the washing water can be controlled.

Further, washing water can be prevented from backflowing to the drain opening during a circulation process, through the rib formed toward the inside of the housing. As a result, since the washing water smoothly moves towards the circulation opening, a water amount can be increased.

Further, washing water can be prevented from backflowing to the circulation opening during a drain process through the rib.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a drain pump for a laundry treating apparatus according to the present invention will be explained in more detail with reference to the attached drawings.

For the sake of brief description with reference to the drawings, the same or equivalent components will be provided with the same reference numbers, and description thereof will not be repeated. A singular expression in the specification includes a plural meaning unless it is contextually definitely represented.

Figure 1:
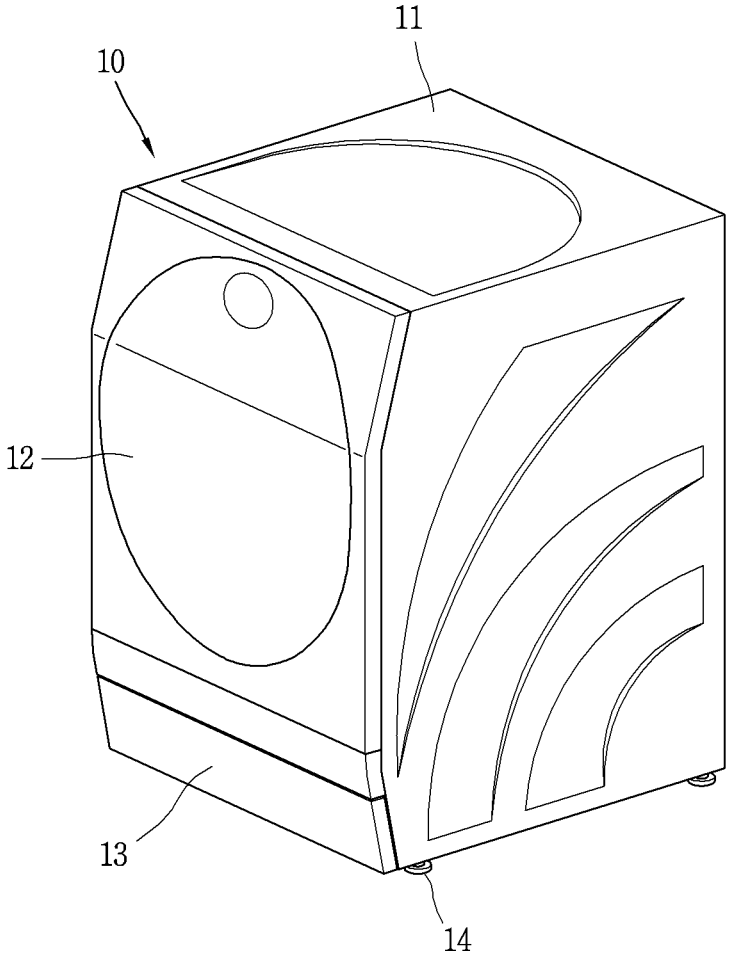
FIG. 1 is a perspective view showing an appearance of a laundry treating apparatus.

FIG. 1 is a perspective view showing an appearance of a laundry treating apparatus 10.

The laundry treating apparatus 10 includes a cabinet 11 which forms an appearance, a drum 21 rotatably mounted in the cabinet 11 and into which laundry is introduced, a lifter (not shown) installed in the drum 21, and a door 12 installed on a front surface of the cabinet 11. A detergent introducing opening cover 13 for covering a detergent introducing opening is disposed at a lower part of the cabinet 11. The laundry treating apparatus 10 includes a duct 15 and a heat exchanger (not shown), because air should circulate in order to dry laundry positioned in the drum 21.

A storage container (not shown) configured to accommodate detergent and a fabric softener and formed to be withdrawn to the outside of the cabinet 11, a plurality of elastic members (not shown) and dampers (not shown) for supporting the drum 21 and preventing vibrations, and a driving motor (not shown) for rotating the drum 21 may be provided at a lower part of the laundry treating apparatus 10. The door 12 through which laundry to be washed is introduced may be provided on a front surface of the cabinet 11. The door 12 may be formed to open and close a front surface of the drum 21. The door 12 may be formed to have a disc shape. An electric heater (not shown) for heating water when a power is applied thereto may be provided at a lower part of the drum 21.

A drain pump for draining washing water inside the drum 21 may be provided below the drum 21. Further, a circulation pump (not shown), for withdrawing water inside the drum 21 and introducing the water to an upper region of the drum 21, is provided below the drum 21. A filter unit (not shown) for collecting foreign materials of the water withdrawn from the drum 21 may be provided at one side of a drain pump 100. A plurality of legs 14 for supporting the laundry treating apparatus 10 in a spaced state from a ground surface by a predetermined height are formed at a lower part of the laundry treating apparatus 10.

Figure 2:
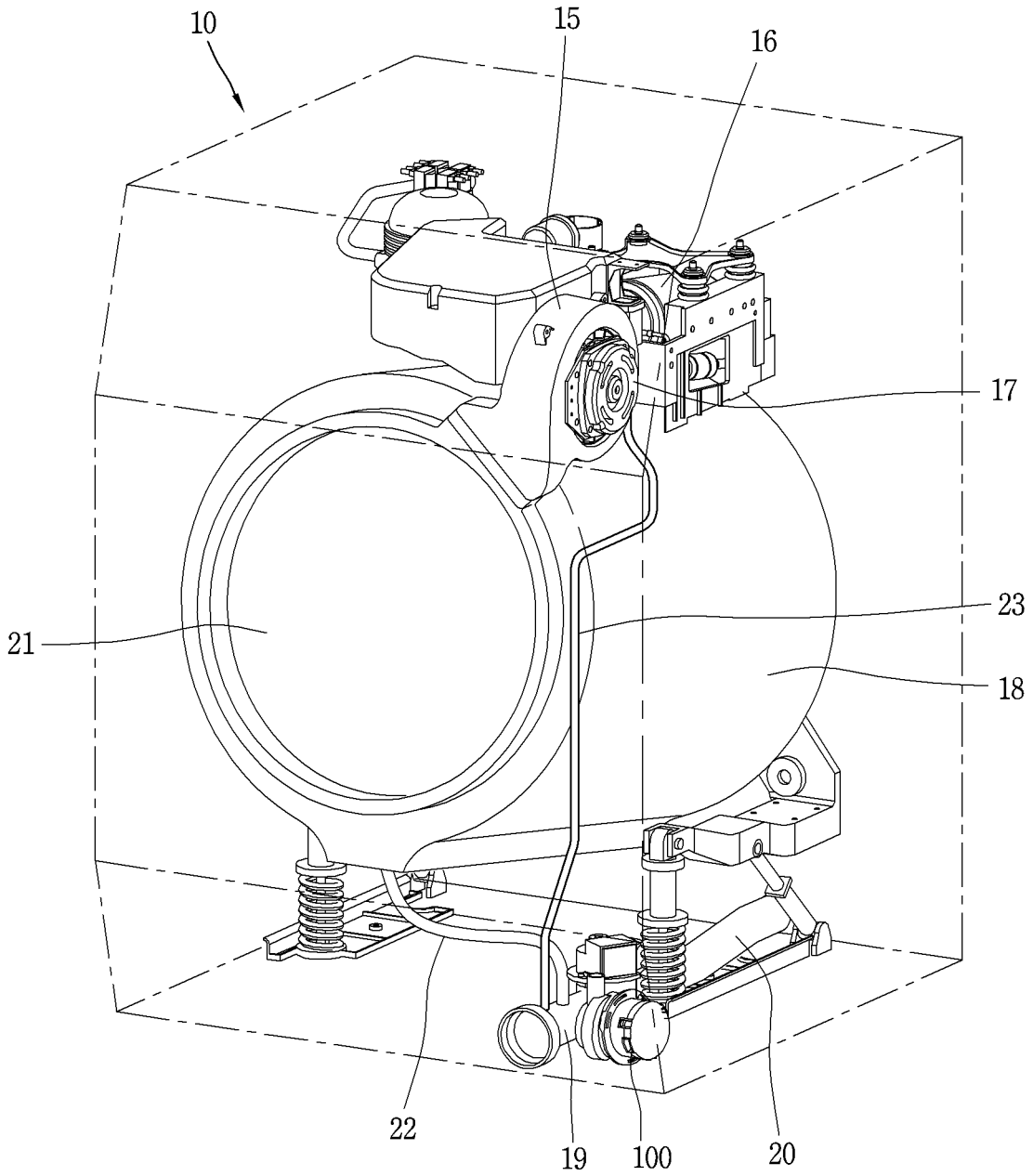
FIG. 2 is a perspective view showing an inner shape of a laundry treating apparatus including a drain pump.

FIG. 2 is a perspective view an inner shape of the laundry treating apparatus 10 including the drain pump 100.

The laundry treating apparatus 10 includes a cabinet 11 which forms an appearance thereof, a tub 18 accommodated in the cabinet 11, and a drum 21 rotatably mounted in the tub 18 and into which laundry is introduced. And the laundry treating apparatus 10 includes a duct 15, a heat exchanger and a fan motor 17 because air should circulate in order to dry laundry inside the drum 21, and includes a compressor 16 and a compressor supporting plate (not shown) for supporting the compressor 16. The laundry treating apparatus 10 includes a condensate water discharge pipe 23 for discharging out condensate water generated from air which passes through a heat exchanger (not shown) as air circulates, a drain pump chamber 19, a drain pump 100, a drain hose 20 and a drain portion connection pipe (not shown).

The drain pump 100 of the present invention is disposed at a lower part of the laundry treating apparatus 10. Once washing water inside the tub 18 moves to the drain pump chamber 19 to be introduced into a housing 110 of the drain pump 100, the drain pump 100 can perform a circulation process for moving the washing water through a circulation opening 111 towards the tub 18 by driving a motor, or can perform a drain process for discharging the introduced washing water to the outside by moving the washing water towards a drain opening 112.

Figure 3:
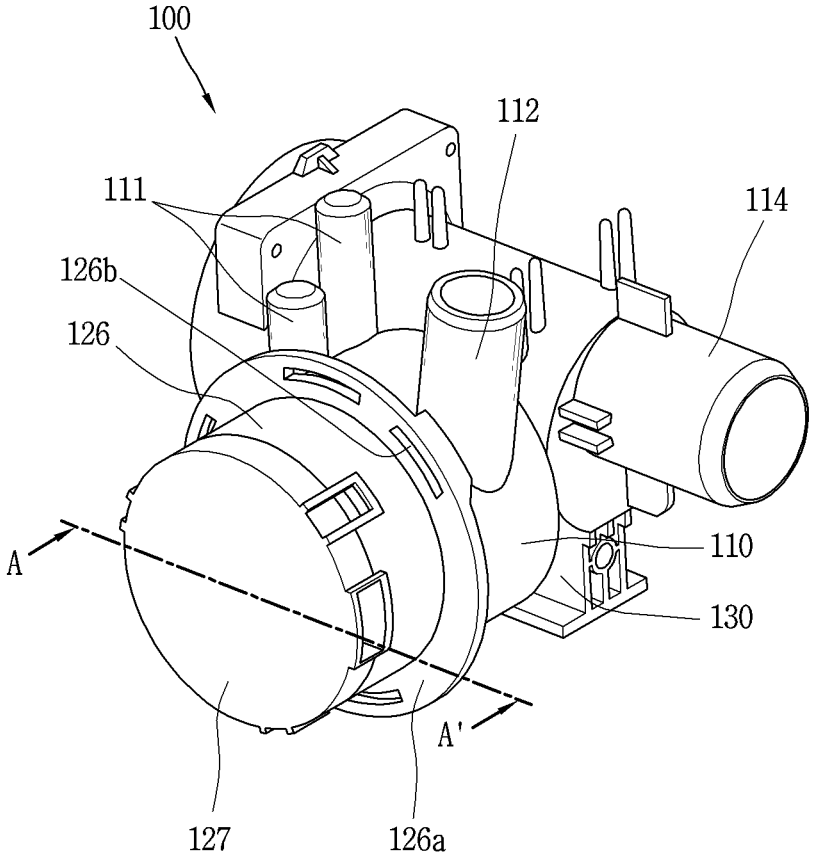
FIG. 3 is a view showing an appearance of a drain pump for a laundry treating apparatus.
Figure 4:
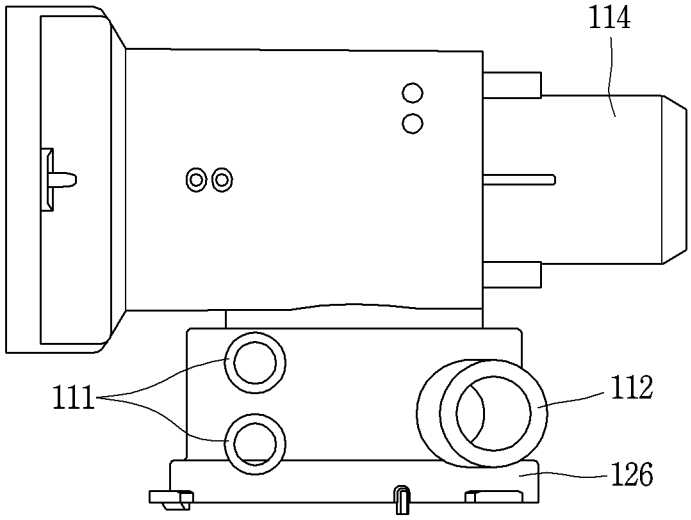
FIG. 4 is a planar view of a drain pump for a laundry treating apparatus, which is shown from an upper side.

FIG. 3 is a view showing an appearance of the drain pump 100 for a laundry treating apparatus. And FIG. 4 is a planar view of the drain pump 100 for a laundry treating apparatus, which is shown from an upper side.

The drain pump 100 for a laundry treating apparatus according to the present invention includes a housing 110 which forms an appearance thereof, an impeller 125 which forms a flow of accommodated washing water by being rotated in the housing 110, and a motor (not shown) for providing a driving force to rotate the impeller 125.

Unlike the conventional drain pump, the drain pump 100 for a laundry treating apparatus according to the present invention may perform both a drain pump function and a circulation pump function, because a rotation direction of the motor can be converted. Further, the drain pump 100 may operate the motor at a high speed during a drain process and operate the motor at a relatively lower speed during a circulation process, because a rotation speed of the motor can be controlled. This may prevent unnecessary noise and power consumption.

That is, the drain pump 100 for a laundry treating apparatus can perform both a drain pump function and a circulation pump function, since washing water introduced from the drain pump chamber 100 can be moved through the drain opening 112 or the circulation opening 111.

The housing 110 forms an appearance of the drain pump 100 which has a cylindrical shape. A water introducing opening 114 for introducing washing water may be formed at one end of the housing 110. A filter (not shown) may be installed at one side of both ends of the water introducing opening 114, such that foreign materials included in washing water may be filtered and then may be moved through the drain pump 100.

Washing water generated during a washing process or a drain process is to introduced into the housing 110 through an inlet 113 of the housing 110 of the drain pump 100. Washing water accommodated in the housing 110 may be discharged to the outside through the drain opening 112 or the circulation opening 111 by the rotating impeller 125. Accordingly, washing water generated during a drain process or a circulation process may be continuously introduced into the housing 110.

As shown in FIG. 3, an impeller case 126 for fixing the motor (not shown) and the impeller 125 is installed at another end of the drain pump 100. The impeller case 126 is fixed in a coupled state to one end of the housing 110 of the drain pump 100, and fixes the motor (not shown) and the impeller 125. The impeller 125 may be rotatable in the drain pump 100 by receiving a rotational force from the motor (not shown) in a connected state to a rotation shaft of the motor.

A flange portion 126*a* protruding outward is formed on an outer circumferential surface of the impeller case 126. A protrusion accommodating portion 126*b* is formed at the flange portion 126*a*, such that the impeller case 126 is fixed in a fitted state to one end of the drain pump 100. A protrusion 119 protruding from an outer circumferential surface of the housing 110 is fitted into the protrusion accommodating portion 126*b*. The protrusion accommodating portion 126*b* may be formed on an outer circumferential surface of the impeller case 126, in plurality, at constant intervals therebetween.

As shown in FIG. 3, the impeller case 126 may further include a circular impeller case cover 127 for restricting the impeller 125 and the motor (not shown) from being exposed to the outside.

The protrusion 119 of the housing 110 may be fixed in a fitted state to the protrusion accommodating portion 126*b* of the impeller case 126. Accordingly, the impeller 125 may be rotatable in the housing 110 in a state that the impeller case 126 is fixed to the housing 110.

The protrusion 119 may be formed on an outer circumferential surface of the housing 110. The protrusion 119 may be formed to protrude outward from the outer circumferential surface of the housing 110. The protrusion 119 may be formed on the outer circumferential surface of the housing 110 in plurality at constant intervals therebetween, so as to correspond to the protrusion accommodating portions 126*b* of the impeller case 126.

The protrusions 119 are inserted into the protrusion accommodating portions 126*b* formed at the flange portion 126*a* of the impeller case 126, and then are fitted thereinto by rotation. As a result, the impeller case 126 may be fixed to the housing 110.

The drain opening 112 and the circulation opening 111 may be formed at the outer circumferential surface of the housing 110. The drain opening 112 communicates with the inside of the housing 110, and protrudes from the outer circumferential surface of the housing 110 in a tangential direction. When the laundry treating apparatus performs a drain process, the drain opening 112 serves as a passage along which accommodated washing water moves to the outside by rotation of the impeller 125 in one direction.

The circulation opening 111 communicates with the inside of the housing 110, and protrudes from the outer circumferential surface of the housing 110 in a tangential direction. When the laundry treating apparatus performs a circulation process, the circulation opening 111 serves as a passage along which accommodated washing water moves to the outside by rotation of the impeller 125 in one direction.

That is, the drain opening 112 and the circulation opening 111 are formed on the outer circumferential surface of the housing 110. And each of the drain opening 112 and the circulation opening 111 is provided with a hose, and serves as a passage along which washing water moves during a drain process or a circulation process. The drain opening 112 and the circulation opening 111 are formed on different positions.

As shown in FIG. 3, the circulation opening 111 may upward protrude from the outer circumferential surface of the housing 110 in a tangential direction. The circulation opening 111 may be formed in a diagonal direction or vertical direction. The circulation opening 111 may be formed in plurality. And a diameter of the circulation opening 111 may be set with consideration of a product size and the amount of washing water which should circulate.

For instance, two circulation openings 111 may be formed on the outer circumferential surface of the housing 110 in a spaced manner from each other. Here, the two circulation openings 111 may have the same diameter or different diameters, and may have the same outward-protruding length or different outward-protruding lengths.

The drain opening 112 may upward protrude from the outer circumferential surface of the housing 110 in a tangential direction. The drain opening 112 is formed on a different position from the circulation opening 111, and may be formed on a position symmetric to a position of the circulation opening 111 based on a virtual line passing through the center of the housing 110 as a set. If one drain opening 112 is formed at the housing 110, a diameter of the drain opening 112 is preferably formed to be greater than that of the circulation opening 111.

Figure 5:
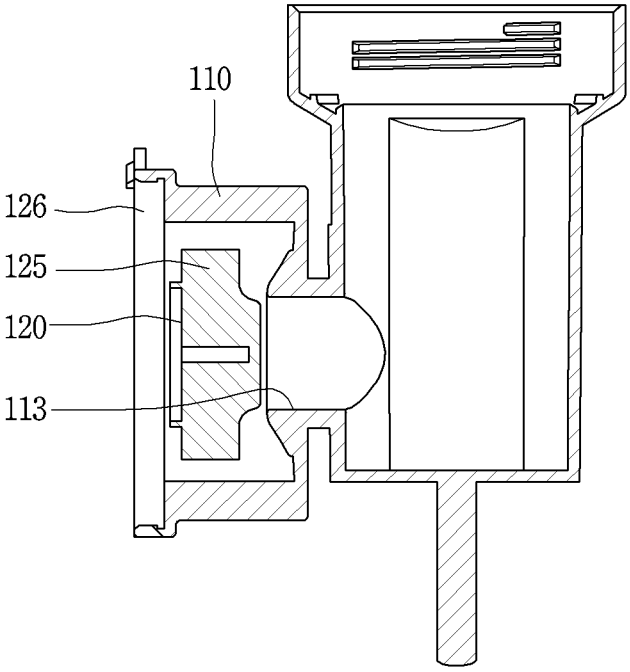
FIG. 5 is a sectional view taken along line 'A-A' in FIG. 3.

FIG. 5 is a sectional view taken along line 'A-A' in the drain pump 100 of FIG. 3.

Referring to the left side of FIG. 5, the impeller case 126 for fixing the impeller 125 is fixed to one end of the housing 110. Since the water introducing opening 114 formed at the cylindrical housing 110 communicates with the drain pump chamber 19, washing water may be introduced into the housing 110.

The motor is positioned at one side inside the housing 110, and a rotation direction and a speed of the motor may be controlled by a controller. The controller (not shown) controls the rotation direction and the speed of the motor by sending a signal to the motor, according to a drain process or a washing process.

In the present invention, the motor may be implemented as a BrushLess Direct Current (BLDC) motor such that its rotation direction and speed can be controlled. The BLDC motor is widely used for home appliances and for industries, and can be miniaturized and can have a small power consumption and less noise.

Unlike a DC motor, the BLDC motor has a semi-permanent lifespan due to a brushless characteristic, and has its current control easy because it can be controlled by a semiconductor device. This enables a precise speed control. Further, the BLDC motor can be rotated at a high speed due to its high torque.

The impeller 125 is coupled to a rotation shaft of the motor, and is rotatable. A rotation direction of the impeller 125 is determined according to a rotation direction of the motor. And a rotation speed of the motor may be controlled by the controller (not shown).

In the present invention, the motor is driven at about 3500 rpm during a drain process, and is driven at about 2500 rpm during a circulation process. A rotation direction of the motor during a drain process is set to be different from a rotation direction of the motor during a circulation process. Generally, a discharge amount during a drain process is larger than the amount of washing water during a circulation process. Accordingly, it is preferable to set a rotation speed of the motor during a drain process, to be larger than a rotation speed of the motor during a circulation process. However, this may be changed according to a user's setting.

Figure 6:
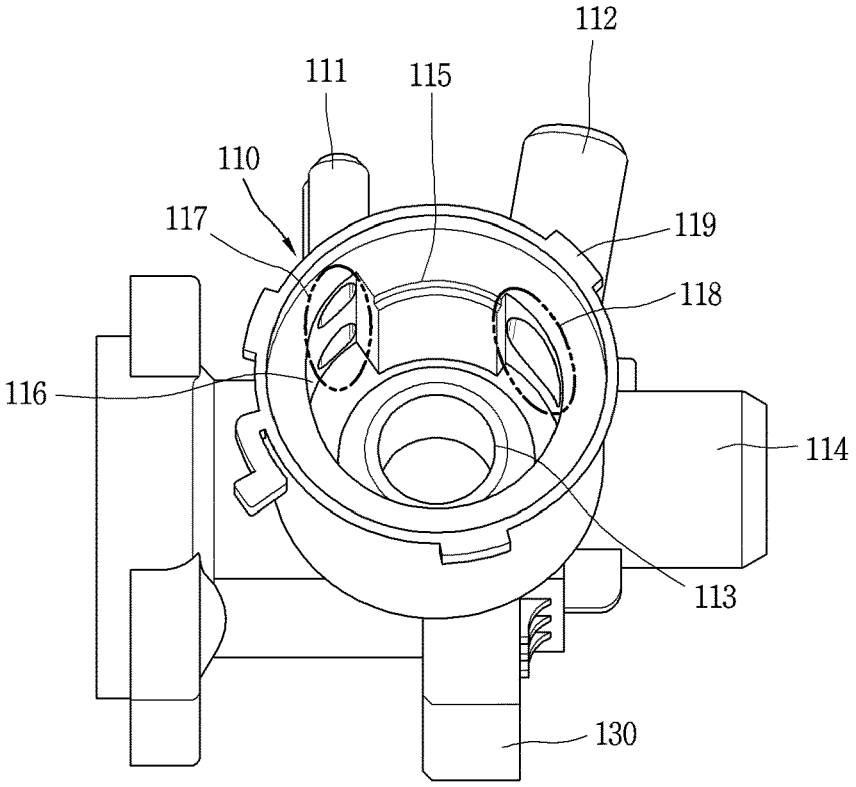
FIG. 6 is a perspective view showing a drain pump according to an embodiment of the present invention.
Figure 7:
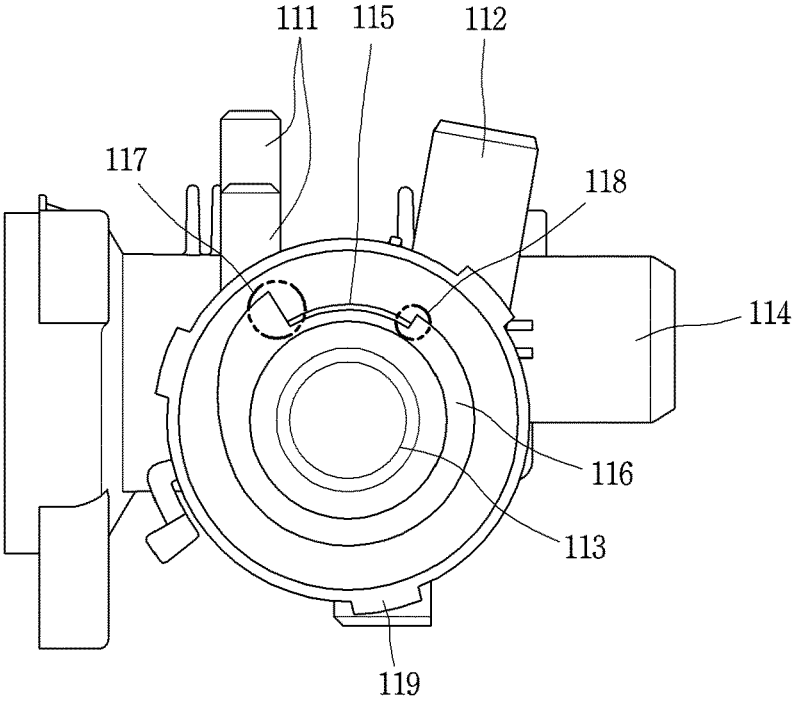
FIG. 7 is a front view of the drain pump of FIG. 6.

FIG. 6 is a perspective view showing the housing 110 of the drain pump according to an embodiment of the present invention, and FIG. 7 is a front view of the housing 110 of the drain pump 100 shown in FIG. 6.

The housing 110 is formed to have a cylindrical shape, and the inlet 113 communicated with the drain pump chamber 19 is formed at one end of the housing 110. And the protrusions 119 for coupling the impeller case 126 thereto are formed at constant intervals therebetween, at another end of the housing 110.

The circulation opening 111 and the drain opening 112 are formed on the outer circumferential surface of the housing 110. A rib 115 protruding toward the inside of the housing 110 is formed on an inner circumferential surface of the housing 110.

The rib 115 protrudes from one end of the inner circumferential surface of the housing 110 towards the inside of the housing 110, and is formed along the inner circumferential surface in a lengthwise direction of the housing 110.

The rib 115 restricts a generation of a vortex in the housing 110 due to a flow of washing water. As washing water accommodated in the housing 110 flows by rotation of the impeller 125, a vortex is generated.

The rib 115 reduces a vortex from being generated when the impeller 125 is rotated, thereby preventing a backflow of washing water to the drain opening 112 during a circulation process, and preventing a backflow of washing water to the circulation opening 111 during a drain process. Especially, if washing water backflows to the drain opening 112 during a circulation process, the amount of water to circulate in the tub is reduced. That is, the rib 115 serves to make washing water smoothly move to the circulation opening 111 or the drain opening 112.

A washing water flowing portion 116 for flowing washing water is formed on an inner circumferential surface of the housing 110, and a first groove 117 and a second groove 118 are formed at the washing water flowing portion 116 so as to be recessed toward the circulation opening 111 and the drain opening 112.

The rib 115 has a shape to protrude toward the inside of the housing 110, from an inner circumferential surface of the housing 110 between the first groove 117 and the second groove 118.

The rib 115 is formed to be spaced apart from the impeller 125 by a predetermined distance, such that the impeller 125 mounted to the housing 110 is rotatable. The distance between the rib 115 and the impeller 125 may be arbitrarily set by a user according to a thickness of the rib 115 and a size of the impeller 125.

The rib 115 protrudes to have a predetermined thickness so as to be spaced apart from the impeller 125 by a predetermined distance. The rib 115 may be provided with a curved portion formed to correspond to an appearance of the impeller 125. The curved portion may have a bent shape having a predetermined curvature so as to correspond to the appearance of the circular impeller 125.

The rib 115 may be formed such that its thickness may be increased toward its one end. The rib 115 may be formed to have its thickness increased towards the first groove 117, and to have its thickness decreased towards the second groove 118. That is, the rib 115 may be formed to have its thickness decreased towards the second groove 118 from the first groove 117. That is, one end of the rib protruding toward the first groove 117 has a greater thickness than another end of the rib protruding toward the second groove 118.

The washing water flowing portion 116 for flowing washing water accommodated in the housing 110 by rotation of the impeller 125 is formed on an inner circumferential surface of the housing 110.

The washing water flowing portion 116 is provided with the first groove 117 and the second groove 118.

The first groove 117 is recessed towards a position communicated with the circulation opening 111, thereby guiding a movement of washing water accommodated in the housing 110. The second groove 118 is recessed towards a position communicated with the drain opening 112, thereby guiding a movement of liquid accommodated in the housing 110.

The first groove 117 and the second groove 118 may be recessed in different shapes. The first groove 117 is formed to have a wider recessed area than the second groove 118, and makes washing water inside the housing 110 smoothly flow to the circulation opening 111. Since the first groove 117 is formed to have a wider recessed area than the second groove 118, a water amount may be increased and thus a backflow of washing water to the drain opening 112 may be reduced during a circulation process.

As shown in FIG. 7, since the first groove 117 is formed to have a wider recessed area than the second groove 118, the washing water flowing portion 116 has an asymmetric shape when viewed from a front side.

Figure 8A:
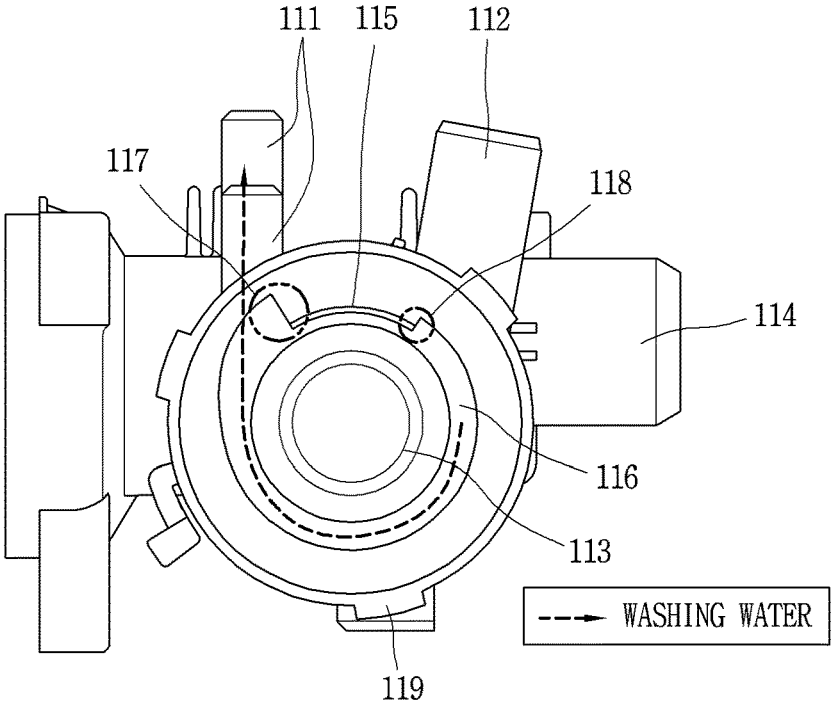
FIG. 8A is a view showing a flow of washing water when an impeller is rotated clockwise.
Figure 8B:
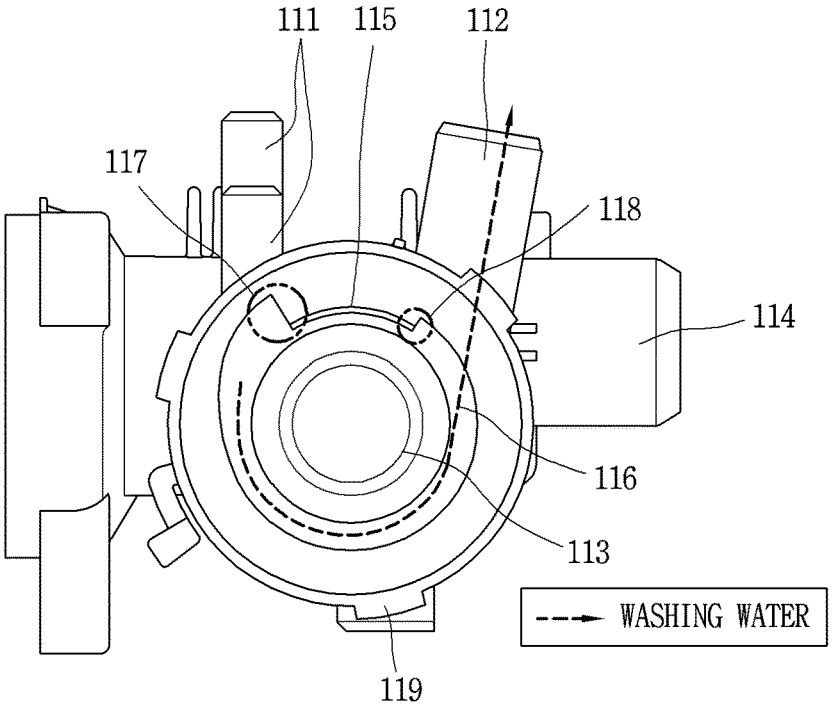
FIG. 8B is a view showing a flow of washing water when the impeller is rotated counterclockwise.

FIGS. 8A and 8B show a flow of washing water by rotation of the impeller 125, which shows a movement of washing water towards the drain opening 112 or the circulation opening 111 by rotation of the impeller 125.

A motor for rotating the impeller 125 in the present invention is a BLDC motor, and its speed and direction can be controlled by the controller. If the BLDC motor is rotated clockwise or counterclockwise, the impeller 125 may be rotated clockwise or counterclockwise, and a flow of washing water accommodated in the housing 110 may be formed.

FIG. 8A shows that washing water accommodated in the housing 110 is discharged toward the circulation opening 111. If the impeller 125 is rotated clockwise, washing water flows clockwise along the washing water flowing portion 116 by the impeller 125, thereby moving towards the circulation opening 111.

Here, the washing water flowing clockwise moves toward the first groove 117 along the washing water flowing portion 116. Accordingly, the washing water is guided to the circulation opening 111 by the rib 115 protruding toward the inside of the housing from one end of the inner circumferential surface of the housing 110.

Since the rib 115 has a shape protruding toward the inside of the housing, the rib 115 serves to make washing water which has moved to the first groove 117 move towards the circulation opening 111, and serves to prevent a backflow of washing water toward the drain opening 112 due to a rotation of the impeller 125. The washing water which flows out through the circulation opening 111 moves to the tub 18 through a connected hose.

FIG. 8B shows that washing water flows counterclockwise along the washing water flowing portion 116 by the impeller 125 when the impeller 125 is rotated counterclockwise.

If the impeller 125 is rotated counterclockwise, washing water accommodated in the housing 110 flows counterclockwise. Here, the washing water flowing counterclockwise moves toward the second groove 118 along the washing water flowing portion 116. Accordingly, the washing water is guided to the drain opening 112 by the rib 115 which protrudes toward the inside of the housing from one end of the inner circumferential surface of the housing 110.

Since the rib 115 has a shape protruding toward the inside of the housing, the rib 115 serves to make washing water which has moved to the second groove 118 move towards the drain opening 112, and serves to prevent a backflow of washing water toward the circulation opening 111 during a drain process.

Figure 9:
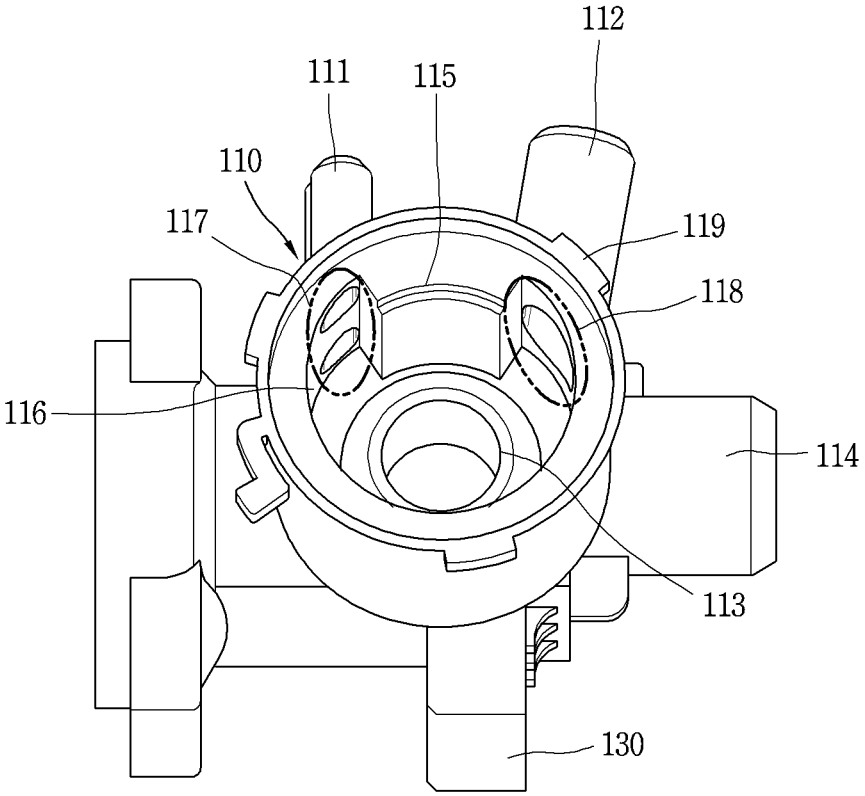
FIG. 9 is a perspective view of a drain pump according to another embodiment of the present invention.
Figure 10:
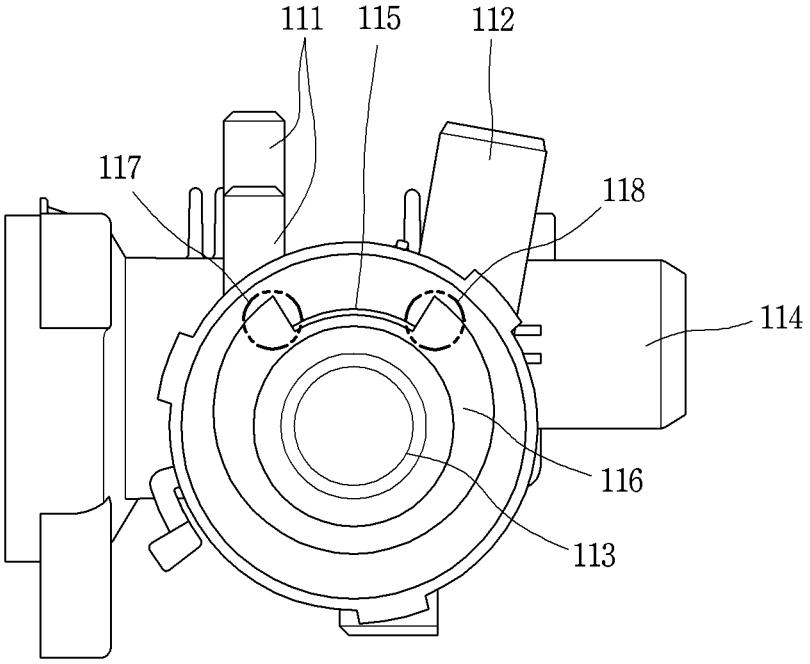
FIG. 10 is a front view of the drain pump of FIG. 9.

FIGS. 9 and 10 are views showing a drain pump according to another embodiment of the present invention. FIG. 9 is a perspective view of the housing 110 of the drain pump, and FIG. 10 is a front view of the housing 110 of the drain pump 100 shown in FIG. 9.

The drain pump shown in FIGS. 9 and 10 has the same function as the aforementioned drain pump 100. However, the shape of the drain pump shown in FIGS. 9 and 10 is different a little from that of the drain pump 100 shown in FIGS. 6 and 7, which will be explained hereinafter.

Referring to FIGS. 9 and 10, the housing 110 is formed to have a cylindrical shape, and the inlet 113 communicated with the drain pump chamber 19 is formed at one end of the housing 110. And the protrusions 119 for coupling the impeller case 126 thereto are formed at constant intervals therebetween, on an outer circumferential surface of another end of the housing 110. The circulation opening 111 and the drain opening 112 are outward formed on the outer circumferential surface of the housing 110.

The rib 115 protruding toward the inside of the housing 110 is formed on an inner circumferential surface of the housing 110. The rib 115 is formed to protrude toward the inside of the housing 110 from one end of the inner circumferential surface of the housing 110, and is formed on the inner circumferential surface of the housing 110 in a lengthwise direction of the housing 110.

The washing water flowing portion 116 for flowing washing water is formed on the inner circumferential surface of the housing 110, and the first groove 117 and the second groove 118 are formed at the washing water flowing portion 116 so as to be recessed toward the circulation opening 111 and the drain opening 112. The rib 115 protrudes toward the inside of the housing 110, from the inner circumferential surface of the housing 110 between the first groove 117 and the second groove 118.

As shown in FIG. 9, the first and second grooves 117, 118 are recessed in the same shape, unlike the housing 110 shown in FIGS. 6 and 7.

As shown in FIG. 9, the first and second grooves 117, 118 are recessed in the same shape, and the rib 115 protrudes toward the inside of the housing 110 from the inner circumferential surface of the housing 110 between the first groove 117 and the second groove 118. With such a configuration, washing water flowing in the housing 110 may move towards the circulation opening 111 or the drain opening 112.

The rib 115 may have the same thickness between the first groove 117 and the second groove 118, and may protrude towards the inside of the housing 110. The rib 115 may protrude to have a predetermined thickness so as to be spaced apart from the impeller 125 by a predetermined distance. The rib 115 may be provided with a curved portion at an outer side thereof, the curved portion formed to correspond to an appearance of the impeller 125. The rib 115 restricts a vortex from being generated when washing water flows in the housing 110, which is the same as the aforementioned configuration.

Referring to FIG. 10, when the washing water flowing portion 116 is viewed from a front side, a recessed area of the first groove 117 is the same as that of the second groove 118. As the right and left upper parts of the washing water flowing portion 116 are recessed to have the same shape, the washing water flowing portion 116 has a symmetric shape right and left.

Figure 11:
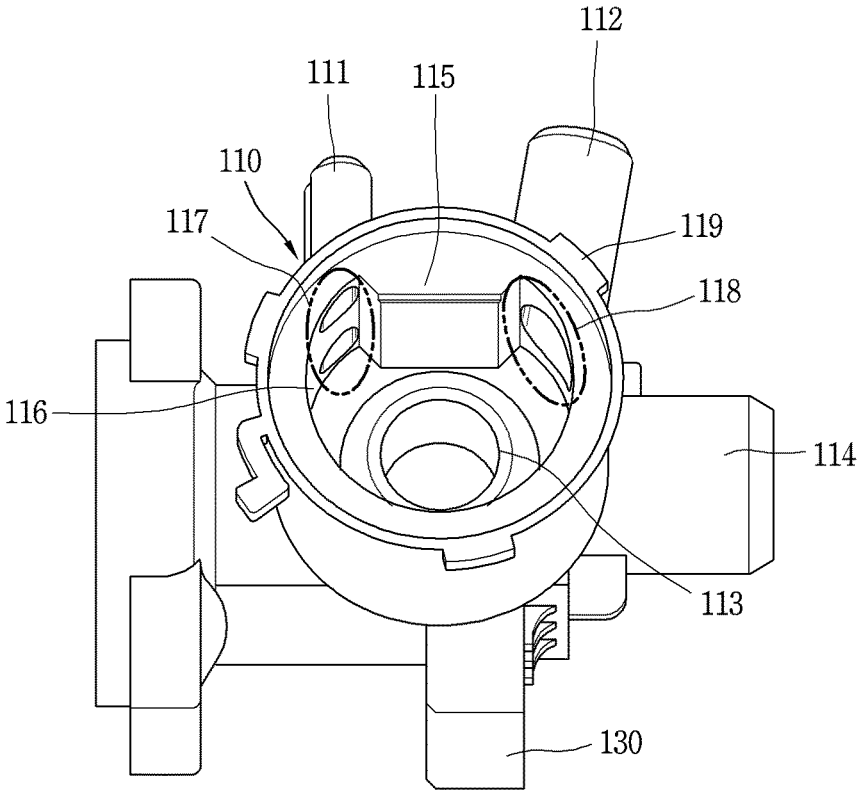
FIG. 11 is a perspective view showing a drain pump according to still another embodiment of the present invention.
Figure 12:
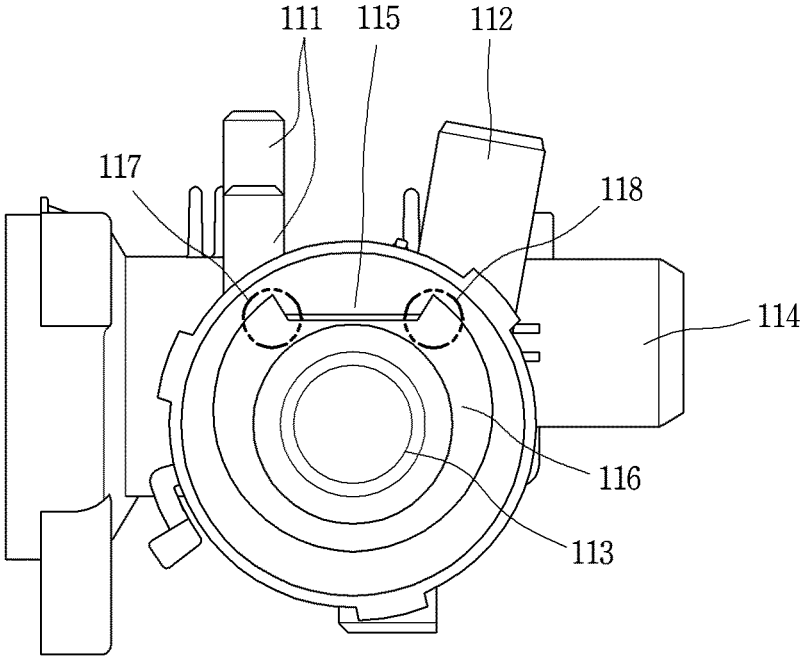
FIG. 12 is a front view of the drain pump of FIG. 10.

FIGS. 11 and 12 are views showing a drain pump according to still another embodiment of the present invention.

As shown in FIG. 11, an outer circumferential surface of the rib 115 protruding from an inner circumferential surface of the housing 110 may be transformed into another shape rather than a curved shape, in correspondence to the shape of the impeller 125.

The rib 115 protrudes towards the inside of the housing 110, and may have a flat outer circumferential surface not a curved one. However, the rib 115 should be spaced apart from the impeller 125 by a predetermined distance, such that the impeller 125 can be rotated in the housing 110. The rib 115 may protrude to have a predetermined thickness so as to be spaced apart from the impeller 125 by a predetermined distance.

As aforementioned, washing water accommodated in the housing 110 can flow by the impeller 125 which rotates clockwise or counterclockwise. With such a configuration, by the rib 115 protruding towards the inside of the housing 110, washing water may be prevented from moving to the drain opening 112 during a circulation process, and may be restricted from moving to the circulation opening 111 during a drain process.

Referring to FIG. 12 which is a front view, the rib 115 protruding from the inner circumferential surface of the housing 110 towards the inside of the housing 110 is provided with a flat outer circumferential surface not a curved one. And the first and second grooves 117, 118 are recessed by the same area.

If the impeller 125 is rotated clockwise by the rib 115, the first groove 117 and the second groove 118, washing water may move towards the first groove 117, and a backflow of the washing water toward the drain opening 112 through the second groove 118 may be restricted by the rib 115 protruding toward the inside of the housing 110. Likewise, if the impeller 125 is rotated counterclockwise, washing water moves towards the second groove 118. Since the washing water is prevented from moving toward the first groove 117, a backflow of the washing water toward the circulation opening 111 may be prevented. As aforementioned, since a rotation direction and a rotation speed of the BLDC motor are controllable by the controller, the impeller 125 may be rotated according to a drain process and a circulation process.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A drain pump for a laundry treating apparatus, the drain pump comprising:

a housing that has a cylindrical shape and that is configured to receive washing water;

an impeller located within the housing;

a motor configured to generate driving force to rotate the impeller;

a circulation outlet that is defined on an outer circumferential surface of the housing and that enables communication of the washing water with the housing, the circulation outlet protruding outward in a first direction tangential to the outer circumferential surface; and a drain outlet that is defined on the outer circumferential surface and that enables communication of the washing water with the housing, the drain outlet being spaced apart from the circulation outlet and protruding outward in a second direction tangential to the outer circumferential surface, wherein the housing includes a rib that protrudes from an inner circumferential surface of the housing, the rib being located between the circulation outlet and the drain outlet and configured to guide the washing water to the circulation outlet or to the drain outlet based on a direction of rotation of the impeller, wherein the housing further includes a washing water flowing portion located at the inner circumferential surface of the housing and configured to guide flow of the washing water based on rotation of the impeller, wherein the washing water flowing portion defines:

a first groove that is recessed from the inner circumferential surface of the housing, that is connected to the circulation outlet, and that is configured to guide the washing water to the circulation outlet, and a second groove that is recessed from the inner circumferential surface of the housing, that is connected to the drain outlet, and that is configured to guide the washing water to the drain outlet, wherein the first groove is recessed from the inner circumferential surface to a first position, and the second groove is recessed from the inner circumferential surface to a second position that is closer to the inner circumferential surface than the first position, and wherein the rib has a thickness that decreases along a direction from the first groove to the second groove, and the thickness of the rib at a first end protruding from the first groove is greater than the thickness of the rib at a second end protruding from the second groove.

2. The drain pump of claim 1, wherein the first groove and the second groove have different shapes.

3. The drain pump of claim 1, wherein the rib extends from the first groove to the second groove.

4. The drain pump of claim 1, wherein the rib is spaced apart from the impeller by a predetermined distance to thereby allow the impeller to rotate in the housing.

5. The drain pump of claim 1, wherein the rib includes a curved portion between the first groove and the second groove, the curved portion facing toward the impeller and having a shape corresponding to a shape of the impeller.

6. The drain pump of claim 1, wherein the housing further includes coupling protrusions that protrude outward from the outer circumferential surface of the housing, the coupling protrusions being arranged along the outer circumferential surface of the housing at a predetermined interval.

7. The drain pump of claim 6, further comprising an impeller cover that supports the impeller, the impeller cover including protrusion accommodating portions configured to receive the coupling protrusions of the housing.

8. The drain pump of claim 1, wherein the motor is a brushless direct current (BLDC) motor type that is configured to rotate at various rotation speeds and in various rotation directions.

9. The drain pump of claim 1, further comprising a controller configured to send a control signal to the motor to thereby rotate the impeller in a preset rotation direction at a preset speed.

10. The drain pump of claim 1, wherein the impeller is configured to rotate in a first direction and a second direction opposite the first direction, wherein the rib is configured to guide the washing water to the circulation outlet based on the impeller rotating in the first direction, and wherein the rib is configured to guide the washing water to the drain outlet based on the impeller rotating in the second direction.

11. The drain pump of claim 1, wherein the housing further defines an inlet through which the housing receives washing water.

12. The drain pump of claim 1, further comprising:

at least one circulation outlet including the circulation outlet; and at least one drain outlet including the drain outlet.

13. The drain pump of claim 7, wherein the impeller cover includes a flange portion that protrudes from an outer circumferential surface of the impeller cover and faces the housing, the flange portion defining the protrusion accommodating portions.

14. The drain pump of claim 1, wherein the rib includes:

a first side surface facing the first groove;

a second side surface facing the second groove; and a third side surface connecting the first and second side surfaces and facing toward the impeller.

15. The drain pump of claim 14, wherein the third side surface is flat, and wherein the first and second side surfaces are inclined with respect to the third side surface.

16. The drain pump of claim 14, wherein the third side surface is curved corresponding to a shape of the impeller.

17. The drain pump of claim 14, wherein the first and second side surfaces have a same width in a radial direction of the housing.

18. A laundry treating apparatus comprising:

a tub configured to accommodate laundry and washing water;

a drain pump configured to receive washing water from the tub and configured to circulate the received washing water to the tub or to discharge the received washing water to an outside, the drain pump including:

a housing that has a cylindrical shape and that is configured to receive washing water;

an impeller located within the housing;

a motor configured to generate driving force to rotate the impeller;

a circulation outlet that is defined on an outer circumferential surface of the housing and that enables communication of the washing water with the housing, the circulation outlet protruding outward in a first direction tangential to the outer circumferential surface; and a drain outlet that is defined on the outer circumferential surface and that enables communication of the washing water with the housing, the drain outlet being spaced apart from the circulation outlet and protruding outward in a second direction tangential to the outer circumferential surface, wherein the housing includes a rib that protrudes from an inner circumferential surface of the housing, the rib being located between the circulation outlet and the drain outlet and configured to guide the washing water to the circulation outlet or to the drain outlet based on a direction of rotation of the impeller, wherein the housing further includes a washing water flowing portion located at the inner circumferential surface of the housing and configured to guide flow of the washing water based on rotation of the impeller, wherein the washing water flowing portion defines:

a first groove that is recessed from the inner circumferential surface of the housing, that is connected to the circulation outlet, and that is configured to guide the washing water to the circulation outlet, and a second groove that is recessed from the inner circumferential surface of the housing, that is connected to the drain outlet, and that is configured to guide the washing water to the drain outlet, wherein the first groove is recessed from the inner circumferential surface to a first position, and the second groove is recessed from the inner circumferential surface to a second position that is closer to the inner circumferential surface than the first position, and wherein the rib has a thickness that decreases along a direction from the first groove to the second groove, and the thickness of the rib at a first end protruding from the first groove is greater than the thickness of the rib at a second end protruding from the second groove.

19. The drain pump of claim 1, wherein the first groove defines a first recessed area that extends radially outward from the inner circumferential surface of the housing, and the second groove defines a second recessed area that extends radially outward from the inner circumferential surface of the housing, and wherein the first recessed area is greater than the second recessed area to thereby reduce a back flow of washing water to the drain outlet.

20. The laundry treating apparatus of claim 18, wherein the first groove defines a first recessed area that extends radially outward from the inner circumferential surface of the housing, and the second groove defines a second recessed area that extends radially outward from the inner circumferential surface of the housing, and wherein the first recessed area is greater than the second recessed area to thereby reduce a back flow of washing water to the drain outlet.

* * * * *